United States Patent [19]

Shitrai

[11] 4,271,336

[45] Jun. 2, 1981

[54] ELECTRICAL SLIP RING AND BRUSH RING ASSEMBLY

[75] Inventor: Arie Shitrai, Raanana, Israel

[73] Assignee: Israel Aircraft Industries Limited, Ben Gurion International Airport, Israel

[21] Appl. No.: 6,246

[22] Filed: Jan. 24, 1979

[30] Foreign Application Priority Data

Jan. 30, 1978 [IL] Israel ..... 53913

[51] Int. Cl.[3] ..... H01H 19/00

[52] U.S. Cl. ..... 200/24; 200/164 A; 200/275

[58] Field of Search ..... 200/23, 24, 11 A, 26, 200/158, 237, 239, 164 R, 164 A, 275; 310/232, 237

[56] References Cited

U.S. PATENT DOCUMENTS

| | | | |
|---|---|---|---|
| 2,937,224 | 5/1960 | Yeagley | 174/28 X |
| 2,967,216 | 1/1961 | Żablocki et al. | 200/11 A X |
| 3,098,129 | 7/1963 | Lynch et al. | 200/24 X |
| 3,242,270 | 3/1966 | Van Volkenburg et al. | 200/11 D |

FOREIGN PATENT DOCUMENTS 1216886 12/1970 United Kingdom .

*Primary Examiner*—J. V. Truhe
*Assistant Examiner*—Morris Ginsburg
*Attorney, Agent, or Firm*—Benjamin J. Barish

[57] ABSTRACT

An electrical current transfer assembly includes a slip ring and a brush ring having an annular array of contact elements engaging the slip ring as one ring rotates with respect to the other, the brush ring being divided into a plurality of equal sectors each carrying a group of the contact elements, the contact elements being interlaced with respect to length among the plurality of groups to provide a distributed balanced engagement of the contact elements with the slip ring.

10 Claims, 4 Drawing Figures

64
66
70
65
68
89
88
71
72
73
74
62
63
80
86
75
76
77
79
78
84
82
81
90

ELECTRICAL SLIP RING AND BRUSH RING ASSEMBLY

BACKGROUND OF THE INVENTION

The present invention relates to an electrical current transfer assembly, and particularly to the type including a slip ring and a brush ring (sometimes called a wiper ring) having an annular array of contact elements (sometimes called wiper elements) engaging the slip ring as one ring, usually the slip ring, rotates with respect to the other ring.

Such assemblies are commonly used for transferring electrical current between a fixed part and a rotary part of an electrical device or transmission system. In the known arrangements, it is common to have the contact elements uniformly vary in length so as to engage different surfaces of the slip ring and thereby to distribute the wear on the slip ring. Examples of such known construction are illustrated in U.S. Pat. No. 2,937,224 and British Pat. No. 1,216,886. These known arrangements, however, tend to produce unbalancing forces on the slip ring since the contact elements engaging the slip ring at a greater radial distance from its center of rotation produce a greater element of force thereon than the contact elements engaging the slip ring at a smaller distance from its center of rotation. Such unbalancing forces affect the smoothness of operation of the assembly. In addition, they increase the rate of wear and therefore may necessitate more frequent maintenance, repair, and replacement of parts of the assembly. Further, such unbalancing forces may be particularly troublesome in arrangements including brush rings engaging the opposite faces of a slip ring coupled to rotate with a shaft, especially when it is desired to permit the slip ring to move (float) axially with respect to the shaft.

SUMMARY OF THE INVENTION

An object of the present invention is to provide an electrical current transfer assembly having advantages in the above respects. More particularly, it is an object of the present invention to provide an assembly including a slip ring and a brush ring assembly which produces a more balanced engagement between the brush ring contact elements and the slip ring.

According to a broad aspect of the present invention, there is provided an electrical current transfer assembly including a slip ring and a brush ring having an annular array of contact elements engaging the slip ring as one ring rotates with respect to the other, characterized in that said brush ring is divided into a plurality of equal sectors each carrying a group of the contact elements, the contact elements being interlaced with respect to length among the plurality of groups to provide a distributed balanced engagement of the contact elements with the slip ring.

By the characterization that the contact elements of the plurality of groups are "interlaced with respect to length," is meant that the contact elements increase in length according to a given sequence but adjacent elements of this sequence belong to different groups, analogous to "interlaced line scanning" wherein adjacent scanning lines belong to different scanning fields. This will be clearer from the description below.

In the preferred embodiment of the invention described below, the contact elements are interlaced with respect to length among the plurality of groups such that all the contact elements of the brush ring form a plurality of series each series including the correspondingly numbered contact element of all the groups, the contact elements in each series uniformly varying in length from one group to the next. Particularly good results have been obtained by using such an interlaced arrangement wherein the sequence of uniformly varying lengths of the contact elements from one group to the next is reversed at the end of each series.

According to a further feature in the preferred embodiment described below, the assembly further includes a rotary shaft passing centrally through the slip ring and the brush ring, said slip ring being coupled to the shaft to rotate therewith, said brush ring being fixed. In one described embodiment there is a brush ring on each side of the slip ring, and the slip ring is axially movable with respect to the shaft, whereby the slip ring is permitted to float between the brush rings on the opposite sides of the slip ring. In a second described embodiment, the slip ring is fixed to the shaft.

Further features and advantages of the invention will be apparent from the description below.

SUMMARY OF THE DRAWINGS

The invention is herein described, by way of example only, with reference to the accompanying drawings, wherein.

DESCRIPTION OF PREFERRED EMBODIMENTS

Figure 1:
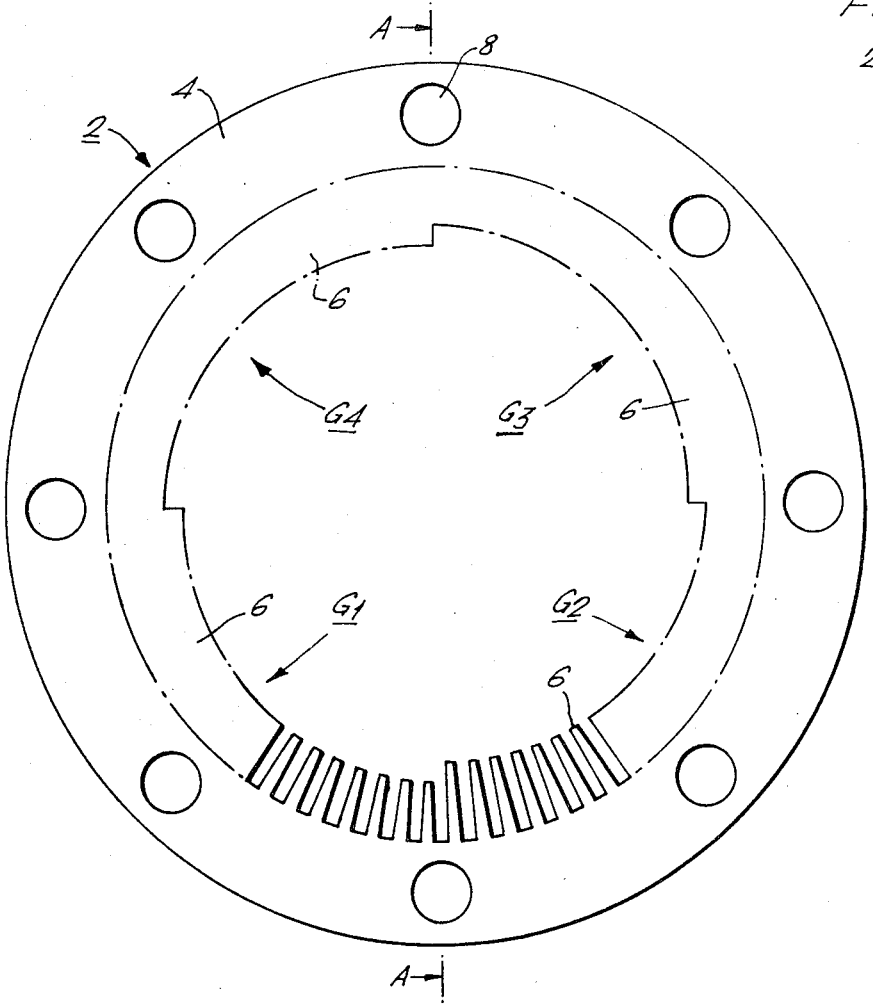
FIG. 1 is a plan view schematically illustrating one form of brush ring constructed in accordance with the invention, FIG. 1*a* being a sectional view along line A—A of FIG. 1.
Figure 1A:
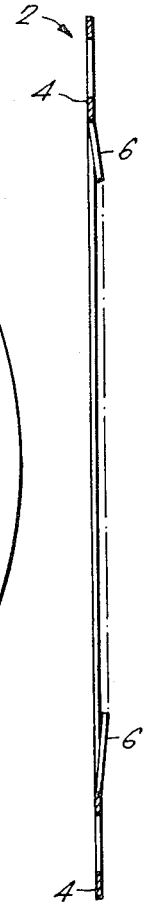

With reference first to FIG. 1, there is illustrated one form of brush or wiper ring 2 constructed in accordance with the invention. The brush ring 2 is made of electrically-conductive material, such as copper, and is formed with an outer annular margin 4 having a plurality of contact or wiper elements 6 in the form of spring-fingers extending radially inwardly thereof.

The brush ring 2 is fixedly mounted by fasteners (not shown) passed through openings 8 formed in the annular margin 4, as described below with respect to FIG. 2.

The brush ring 2 is divided into four equal sectors each sector carrying a group G1–G4 having an equal number of the spring fingers 6. The spring fingers 6 are interlaced with respect to length among the four groups G1–G4 to provide a distributed balanced engagement of the contact elements with the slip ring (not shown in FIG. 1).

Table I below sets forth one form of interlaced relationship which may be used in the FIG. 1 arrangement wherein each of the four groups G1–G4 includes 14 spring fingers, or a total of 56 spring fingers in the whole brush ring 2.

TABLE I

| | G1 | G2 | G3 | G4 |
|---|---|---|---|---|
| S1 | R1 = RO + r | R15 = RO + 2r | R29 = RO + 3r | R43 = RO + 4r |
| S2 | R2 = RO + 8r | R16 = RO + 7r | R30 = RO + 6r | R44 = RO + 5r |
| S3 | R3 = RO + 9r | R17 = RO + 10r | R31 = RO + 11r | R45 = RO + 12r |
| S4 | R4 = RO + 16r | R18 = RO + 15r | R32 = RO + 14r | R46 = RO + 13r |
| S5 | R5 = RO + 17r | R19 = RO + 18r | R33 = RO + 19r | R47 = RO + 20r |
| S6 | R6 = RO + 24r | R20 = RO + 23r | R34 = RO + 22r | R48 = RO ++21r |
| S7 | R7 = RO + 25r | R21 = RO + 26r | R35 = RO + 27r | R49 = RO + 28r |
| S8 | R8 = RO + 32r | R22 = RO + 31r | R36 = RO + 30r | R50 = RO + 29r |
| S9 | R9 = RO + 33r | R23 = RO + 34r | R37 = RO + 35r | R51 = RO + 36r |
| S10 | R10 = RO + 40r | R24 = RO + 39r | R38 = RO + 38r | R52 = RO + 37r |
| S11 | R11 = RO + 41r | R25 = RO + 42r | R39 = RO + 43r | R53 = RO + 44r |
| S12 | R12 = RO + 48r | R26 = RO + 47r | R40 = RO + 46r | R54 = RO + 45r |
| S13 | R13 = RO + 49r | R27 = RO + 50r | R41 = RO + 51r | R55 = RO + 52r |
| S14 | R14 = RO + 56r | R28 = RO + 55r | R42 = RO + 54r | R56 = RO + 53r |

It will be seen from the above Table 1 that all of the spring fingers 6 of the brush ring 2 form a plurality of series S1–S14, each series including the correspondingly numbered spring finger of all four groups. Thus, the first series S1 includes spring fingers R1, R15, R29, and R43, which is the first spring finger of each of the four groups G1, G2, G3, G4, respectively. Since there are fourteen spring fingers in each group, there would be fourteen such series (S1–S14) of correspondingly numbered spring fingers; and since there are four sector groups, there would be four spring fingers in each series.

It will also be seen from Table 1 that the spring fingers 6 in each series uniformly increase in length from one group to the next. Thus, in series S1, the contact elements R1, R15, R29, and R43 increase in length by the dimension "r" from one group (G1–G4) to the next.

It will be further seen from Table 1 that the sequence of uniformly increasing lengths from one group to the next is reversed at the end of each series. Thus, in series S1, the sequence of uniformly increasing lengths is in the direction from group G1 (spring finger R1) to group G4 (spring finger R43), but at end of series S1 and the beginning of the next series S2, the sequence is reversed and is in the direction of group G4 (spring finger R44) to group G1 (spring finger R2). The sequence is again reversed at the end of series S2 and the beginning of series S3, wherein the sequence of uniformly increasing lengths of the spring fingers proceeds in the direction of group G1 (spring finger R3) to group G4 (spring finger R45). At the end of series S3, the sequence of uniformly increasing lengths is again reversed for series S4 wherein the direction is from group G4 (spring finger R46) to group G1 (spring finger R4).

This interlaced arrangement, with respect to the lengths of the spring fingers in the four groups G1–G4, continues through all fourteen series S1–S14 of the spring fingers, with the sequence of uniformly increasing lengths from one group to the next being reversed at the end of each series, so that the longest spring finger is R14, namely the fourteenth spring finger in group G1. Since each of the 56 spring fingers increases uniformly by the dimension "r", spring finger R14 is larger than the basic length (R0) by the additional length 56r.

Figure 2:
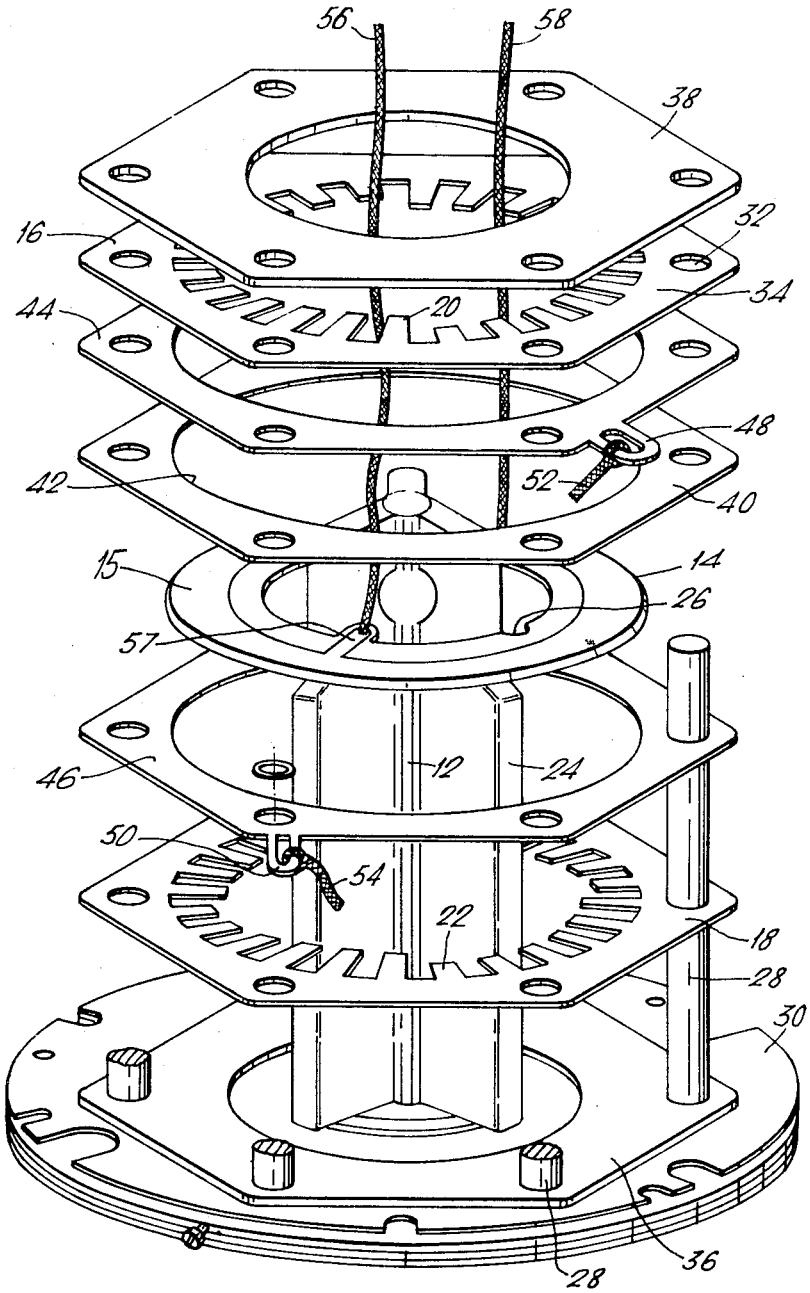
FIG. 2 is an exploded view illustrating one form of low-current transfer assembly constructed in accordance with the invention, using brush rings each as illustrated in FIG. 1.
Figure 3:
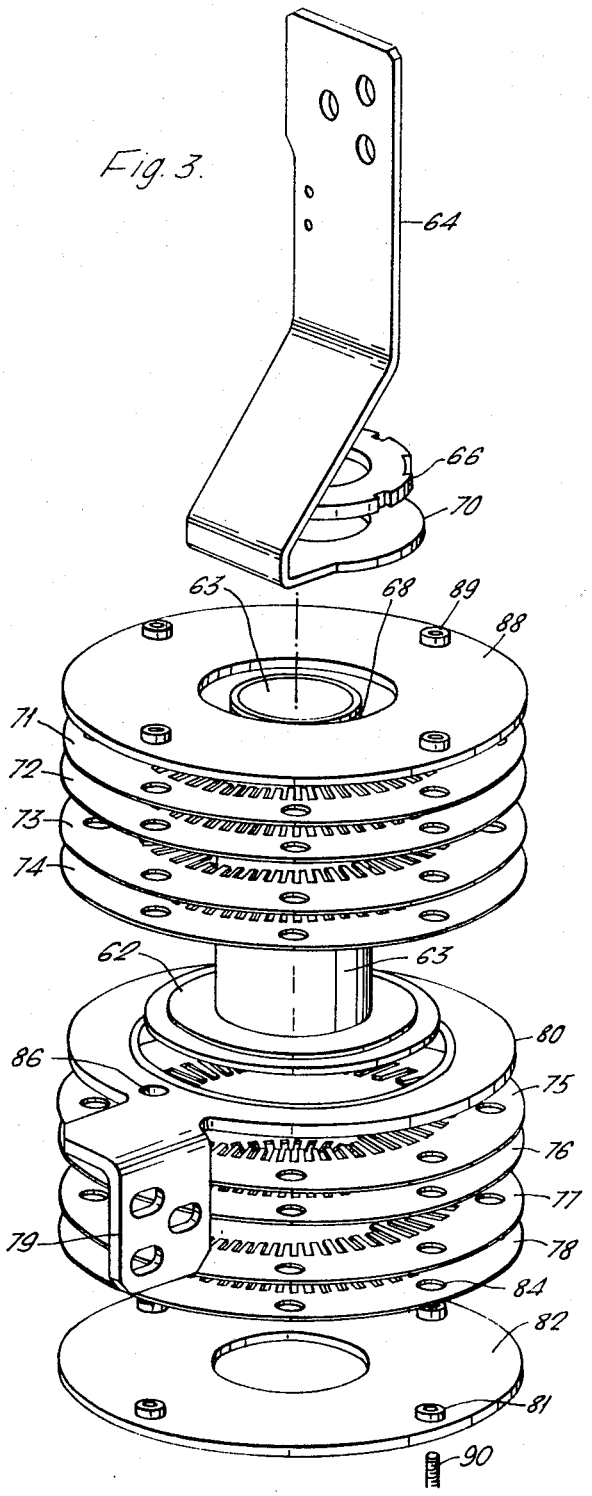
FIG. 3 is an exploded view illustrating one form of high-current transfer assembly constructed in accordance with the invention, and using brush rings such as illustrated in FIG. 1.

Such an interlaced relationship of the spring fingers with respect to their lengths, among the plurality of groups G1–G4, has been found to produce an evenly balanced, distributed engagement of the spring fingers with respect to the slip ring when used in an electrical current transfer assembly, as illustrated in FIGS. 2 or 3, for example.

FIG. 2 illustrates one form of electrical current transfer assembly including brush rings constructed as described above, the assembly of FIG. 2 being particularly useful for low-current applications.

The assembly illustrated in FIG. 2 includes a central rotary shaft 12, an electrically-conductive slip ring 14 coupled to rotate with shaft 12, and a pair of fixed brush rings 16, 18, disposed on opposite sides of the slip ring 14. Actually, slip ring 14 is of insulating material and includes a conductive ring (e.g. 15) on each of its opposite faces. Each of the brush rings 16, 18 includes a plurality of spring fingers 20, 22, respectively, engaging the opposite faces of the slip ring as it is rotated by shaft 12.

It will be appreciated that each of the brush rings 16, 18, is constructed as described above with respect to FIG. 1, namely by being divided into a plurality (e.g., 4 as in FIG. 1) of equal sector groups, each including a plurality (e.g. 14) of the spring fingers (20, 22), which spring fingers are interlaced with respect to length among the plurality of groups.

Rotary shaft 12 is provided with a plurality (e.g., 3) of radial vanes 24 the edges of which are seatable within recesses 26 formed in the slip ring 14, whereby the slip ring is coupled to rotate with the shaft 12 but is movable axially with respect to it; thus, the slip ring 14 may axially "float" between the brush rings 16, 18, as the slip ring rotates with shaft 12. The brush rings 16, 18, are fixed against rotation by means of a plurality of outer pins 28 secured between end discs 30 (only the bottom one of which is shown in FIG. 2) and passing through openings formed through the outer annular margin of the brush rings, e.g., as shown by opening 32 in the outer margin 34 of the brush ring 16. Insulating washers 36, 38, are fixed at the opposite end of the assembly by pins 28, and a further insulating washer 40 is similarly fixed within the assembly. The latter washer 40 is disposed between conductive washers 44, 46 (described below) and is formed with a large central opening 42 of larger diameter than the outer diameter of the slip ring 14 to permit the slip ring to "float" (i.e., move axially) within washer 40 while the spring fingers 20 and 22 of the brush rings 16 and 18 engage the slip ring.

Preferably, the above-mentioned pair of electrically-conductive washers 44, 46 are fixed in the assembly by pins 28. Each of the latter washers is disposed between the insulating washer 40 and one of the brush rings 16, 18, and includes a large central opening also of larger diameter than that of the slip ring 14 to permit the slip ring to float within it while the spring fingers of the respective brush ring contact the confronting face of the slip ring. The electrical connections to the brush rings are made via the conductive washers 44, 46, each including a terminal 48, 50 for attaching an electrical conductor 52, 54.

The electrical connections to the slip ring 14 are made via a first electrical conductor 56 attached to terminal 57 of the conductive ring 15 carried on one face of the slip ring, and a second electrical conductor 58 attached to a corresponding terminal (not shown) of the conductive ring (not shown) carried on the opposite face of the slip ring.

It will thus be seen that the transfer of electrical current between conductors 56 and 58 connected to the opposite faces of the rotating slip ring 14, and conductors 52 and 54 connected to the fixed brush rings 16 and 18, is effected by the spring fingers 20, 22 of the brush rings 16, 18, engaging the opposite faces of the slip ring. It will also be seen that this transfer of electrical current is accompanied by a balanced distribution of forces on the slip ring, by virtue of the interlaced relationship of the contact elements as described above with respect to FIG. 1, thereby producing a very smooth operation of the assembly in which the slip ring is permitted to float between the two brush rings.

FIG. 3 illustrates another electrical current transfer assembly including brush rings constructed as described above with respect to FIG. 1, the assembly of FIG. 3 being particularly useful for high-current applications.

The assembly illustrated in FIG. 3 includes a solid metal slip ring 62 having a sleeve-like extension or hollow shaft 63 integrally machined therewith. An electrical connection is made to extension 63 of slip ring 62 via a conductor terminal 64. The latter is secured to the end of extension 63 by a nut 66 threaded onto the threaded end 68 of the extension over an apertured lug 70 carried by terminal 64.

The assembly of FIG. 3 includes eight brush rings, four (71–74) of which are disposed on one side of slip ring 62, the remaining four brush rings (75–78) being disposed on the opposite side of the slip ring. Electrical connection is made to the brush rings 75–78 by an electrical terminal 79 carried by a conductive washer 80 disposed between brush rings 74 and 75, which washer is in the same plane as and circumscribes slip ring 62. All the brush rings 71–78 are secured in electrical contact along their outer margins, and are fixed against rotation, by bushings 81 formed integrally in insulating end plate 82, which bushings pass through openings 84 formed in the outer margins of the brush rings and openings 86 formed in the conductive washer 80. Another insulating end plate 88 is provided at the opposite end of the assembly, and the assembly is secured together under compression by threaded pins 90 passing through bushings 81 in insulating end plate 82, and similar bushings 89 in the opposite end plate 88.

All the brush rings 71–78 are constructed as described above to provide, on each brush ring, an annular array of spring fingers divided into sector groups and interlaced with respect to length among the sector groups, as described above with respect to FIG. 1. In addition, the center openings of the inner two brush rings 73, 74 on one side of the slip ring 62 are of larger diameter than the two outer ones 71, 72, so that the spring fingers of the outer two brush rings 71, 72 engage the slip ring 62 at a smaller radial distance from its center than the spring fingers of the inner two brush rings 73, 74. In addition brush ring 71 is rotatably or angularly displaced, by the width of one (or more) spring fingers, for example, from its adjacent brush ring 72; and similarly brush ring 73 is rotatably or angularly displaced from brush ring 74, so that the spring fingers of identical length in each such pair of brush rings will not be exactly aligned. A similar arrangement is provided with respect to brush rings 75–78 engaging the opposite surface of the slip ring 62.

While the above-described example of FIG. 1 (and similarly of FIGS. 2 and 3) includes four sector groups G1–G4, each having fourteen spring fingers (and thereby fourteen series S1–S14 of correspondingly numbered spring fingers), it will be appreciated that the brush ring could be divided into a different number of sector groups each having a different number of spring fingers, according to the intended application of the assembly. Generally speaking, it is preferable to have the brush ring divided into at least three sector groups, each sector group having at least ten spring fingers. it is preferable to have the brush ring divided into at least three sector groups, each sector group having at least ten spring fingers.

What is claimed is:

1. An electrical current transfer assembly including a slip ring and a brush ring havng an annular array of contact elements engaging the slip ring as one ring rotates with respect to the other, characterized in that said brush ring is divided into a plurality of equal sectors each carrying a group of the contact elements, the contact elements being interlaced with respect to length among the plurality of groups to provide a distributed balance engagement of the contact elements with the slip ring.

2. An assembly according to claim 1, wherein the contact elements are interlaced with respect to length among the plurality of groups such that all the contact elements of the brush ring form a plurality of series, each series including the correspondingly numbered contact element of all the groups, the contact elements in each series uniformly varying in length from one group to the next.

3. An assembly according to claim 2, wherein the sequence of uniformly varying lengths of the contact elements from one group to the next is reversed at the end of each series.

4. An assembly according to claim 1, wherein said contact elements are spring-fingers formed in the brush ring.

5. An assembly according to claim 4, wherein said spring-fingers extend radially inwardly of the brush ring.

6. An assembly according to claim 1, wherein said brush ring is divided into four equal sectors.

7. An assembly according to claim 1, wherein each sector of the brush ring includes a group of at least ten contact elements.

8. An assembly according to claim 1, further including a rotary shaft passing centrally through the slip ring and the brush ring, said slip ring being coupled to the shaft to rotate therewith, said brush ring being fixed.

9. An assembly according to claim 7, wherein there is at least one said brush ring on each side of the slip ring.

10. An assembly according to claim 8, wherein said slip ring is axially movable with respect to said shaft.

* * * * *